United States Patent [19]

LoBue

[11] 4,252,299

[45] Feb. 24, 1981

[54] METHOD AND APPARATUS FOR DISCHARGING MATERIAL FROM A SHAFT FURNACE

[75] Inventor: Alphonse T. LoBue, Elizabeth Forward Township, Allegheny County, Pa.

[73] Assignee: United States Steel Corporation, Pittsburgh, Pa.

[21] Appl. No.: 1,819

[22] Filed: Jan. 8, 1979

[51] Int. Cl.[3] ..... C21B 13/02

[52] U.S. Cl. ..... 266/44; 75/34; 137/240; 221/1; 222/148; 222/426; 222/556; 222/561; 251/326; 266/195

[58] Field of Search ..... 266/44, 144, 137, 195, 266/196; 75/34, 35; 222/148, 426, 561, 559, 556; 221/1; 137/240; 251/326

[56] References Cited

U.S. PATENT DOCUMENTS

| | | | |
|---|---|---|---|
| 1,119,473 | 12/1914 | Thacher | 423/27 |
| 2,862,808 | 12/1958 | DeJahn | 75/34 |
| 3,710,808 | 1/1973 | Celada et al. | 75/34 |
| 3,799,367 | 3/1974 | Grewer et al. | 198/569 |
| 3,955,693 | 5/1976 | Legille et al. | 137/240 |
| 4,070,161 | 1/1978 | Harter | 251/326 |

*Primary Examiner*—Michael L. Lewis

*Attorney, Agent, or Firm*—Walter P. Wood; William A. Danchuk

[57] ABSTRACT

A method and apparatus for discharging freshly reduced material from a shaft furnace and controlling release of spent reducing gases so that they are not a hazard. The apparatus includes a pair of surge bins and means for directing material selectively to either bin. Gas-seal valves having purge means are located above the respective bins. Gas-seal flapper valves are located below and are movable to positions wholly out of the path of material discharging from the bins.

4 Claims, 4 Drawing Figures

13
18
14
15
43
44
20
19
41
42
21
23
22
24
VENT
36
36
39
40
37
10
12
38
31
32
16
17
27
33
34
28
25
26
29
30
35

METHOD AND APPARATUS FOR DISCHARGING MATERIAL FROM A SHAFT FURNACE

This invention relates to an improved method and apparatus for discharging freshly reduced material from a shaft furnace.

Although the invention is not thus limited, the method and apparatus are particularly useful for discharging sponge iron from a shaft furnace in which pellets or briquettes of iron ore are subjected to a direct reduction process. In such processes the pellets or briquettes are introduced to the top of the furnace and travel downwardly. Within the furnace they are exposed to hot reducing gases, commonly hydrogen and/or carbon monoxide. Release of spent reducing gases must be controlled so that they are not a hazard. Sponge iron discharges from the bottom of the furnace, but it reoxidizes readily and must cool out of contact with air, either within or outside the furnace. Reference can be made to Grewer et al U.S. Pat. No. 3,799,367 for a showing of one form of apparatus for discharging sponge iron from a shaft furnace.

Some shaft furnaces are operated to discharge freshly reduced material while it is still at a high temperature. The discharge apparatus must not only control release of spent reducing gas, but is must also maintain the material out of contact with air. The furnace and discharge apparatus shown in the Grewer patent are of this type, and the sponge iron must be carried away in closed vessels from which all oxygen has been removed. Other shaft furnaces are operated to cool freshly reduced material to a temperature of 150° F. or lower before it leaves the furnace. At this temperature materials such as sponge iron do not reoxidize significantly if exposed to air. The discharge apparatus of the present invention is intended mainly for use with shaft furnaces operated in the latter fashion.

An object of my invention is to provide an improved discharge method and apparatus which continuously receive freshly reduced material from a shaft furnace and effectively control escape of spent reducing gases to the atmosphere so that they do not become a hazard.

A further object is to provide a discharge apparatus which embodies surge bins and improved gas-seal valves mounted near the entry of said bins, said valves having resilient seats and purge means for clearing the seats of particles accumulated while the valves are open.

A further object is to provide a discharge apparatus equipped with improved gas-seal flapper valves at the bottom of the surge bins, which valves travel through elliptical arcs on opening to positions wholly out of the path of material discharging from the bins.

Figure 1:
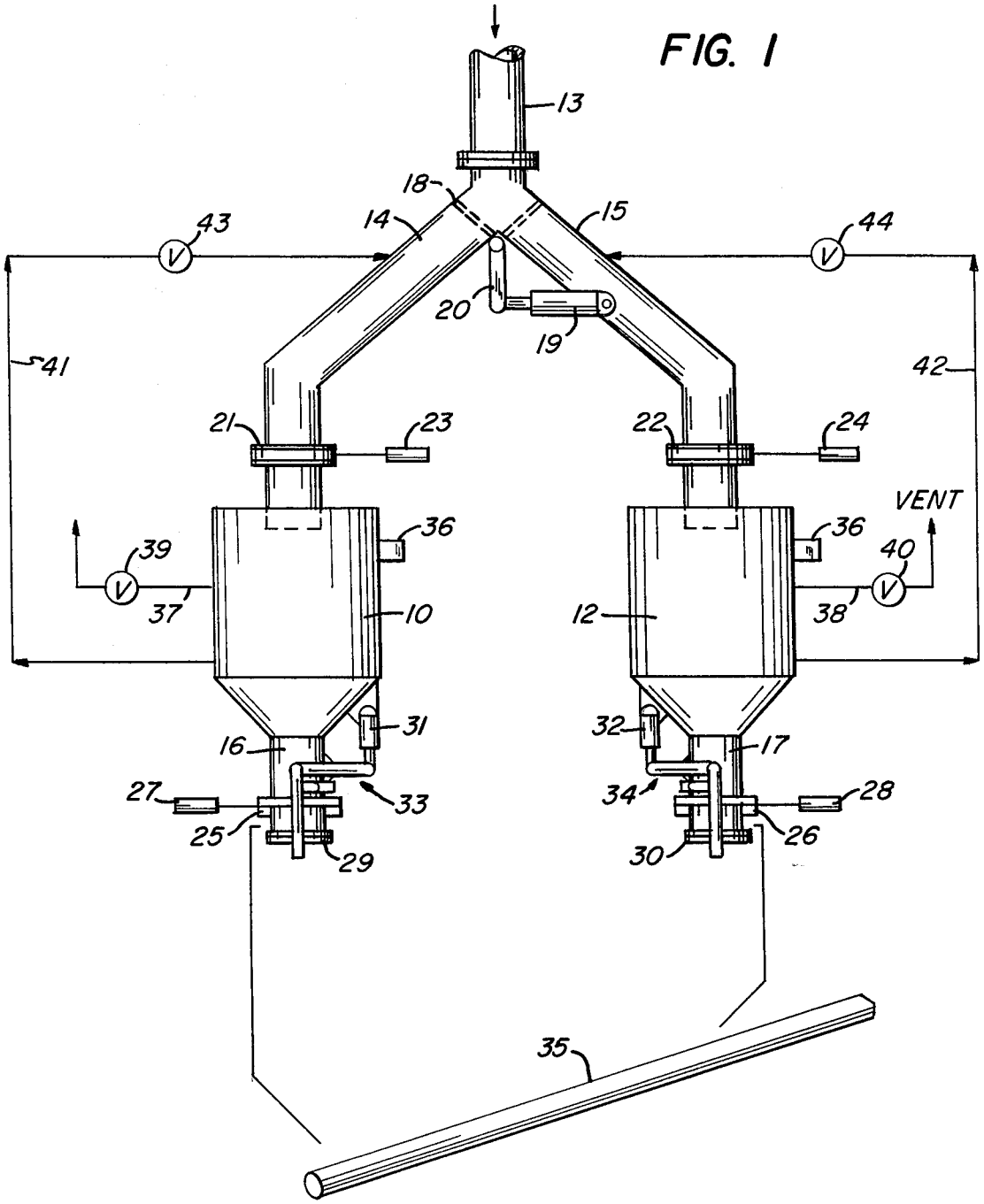
FIG. 1 is a diagrammatic side elevational view of a discharge apparatus constructed in accordance with the invention.

As shown in FIG. 1, the apparatus comprises a pair of surge bins 10 and 12, a downcomer 13 leading from a shaft furnace (not shown), chutes 14 and 15 leading from the downcomer to the respective surge bins, and chutes 16 and 17 leading from the bottoms of the surge bins. A diverter gate 18 is mounted at the bottom of the downcomer 13. The diverter gate 18 is operated by a double-acting fluid pressure cylinder 19 connected to an arm 20 to allow material from the furnace to flow selectively into chutes 14 and 15. Gas-seal gate valves 21 and 22, hereinafter more fully described, are mounted in chutes 14 and 15 and are operated by double-acting cylinders 23 and 24. Gate valves 25 and 26 are mounted in chutes 16 and 17 to control discharge of material from the surge bins, and are operated by cylinders 27 and 28. Gas-seal flapper valves 29 and 30, hereinafter more fully described, are mounted at the bottom ends of chutes 16 and 17, and are operated by double-acting cylinders 31 and 32 through linkages 33 and 34. Material discharging from the chutes 16 and 17 is at a temperature at which it does not reoxidize significantly and may be received on any suitable device, such as a belt conveyor 35.

The surge bins 10 and 12 are equipped with conventional level indicators 36. Vent lines 37 and 38 are connected to the bins 10 and 12 respectively and extend to a suitable stack away from the work area. The lines 37 and 38 contain respective vent valves 39 and 40. Equalizer lines 41 and 42 are connected to the lower portions of the surge bins and extend to the respective chutes 14 and 15 where they are connected above the gas seal valves 21 and 22. The lines 41 and 42 contain respective equalizer valves 43 and 44.

Figure 2:
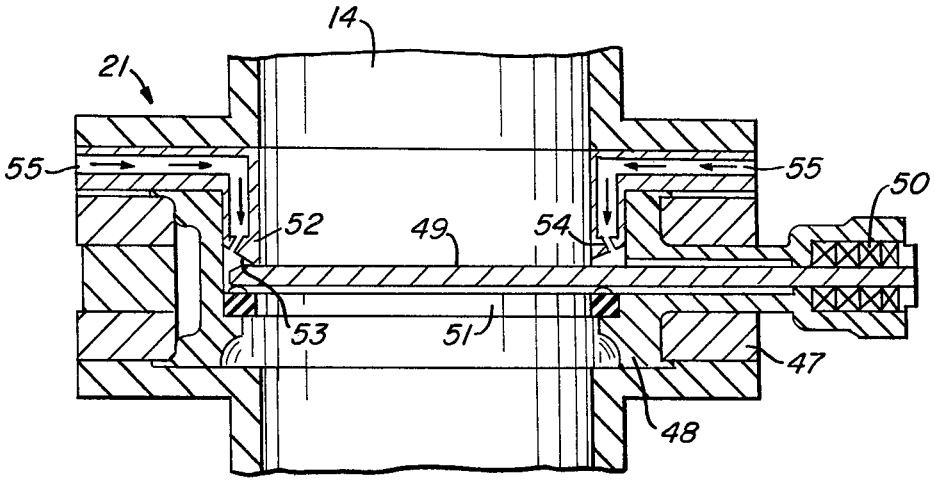
FIG. 2 is a vertical sectional view of one of the gas-seal gate valves and its seat.

FIG. 2 shows the gas-seal gate valve 21 in more detail. Valve 22 is similar; hence the showing and description are not repeated. Valve 21 includes an annular housing 47, an annular valve body 48 within the housing, and a gate 49 slidably mounted in the valve body. The valve body contains packing 50 to prevent leakage around the gate. An annular resilient seat 51 is mounted on the inside of the valve body beneath the gate. An annular purge manifold 52 is mounted on the valve body above the seal 51 and gate 49. The lower edge of the manifold slopes, as indicated at 53, and the manifold has a plurality of outlets 54 extending through its sloping edge and directed toward the seat 51. Preferably the manifold is divided into two approximately semi-circular sections having inlets 55 spaced 180° apart. Any suitable fluid may be introduced at high pressure to the manifold to purge the seat of particles and cool it, but I prefer to use a nonoxidizing gas, such as nitrogen or products of combustion, as the purge fluid. Thus the gate can engage the seat in a gas-tight relation, and the seat is protected against undue wear from abrasive particles.

Figure 4:
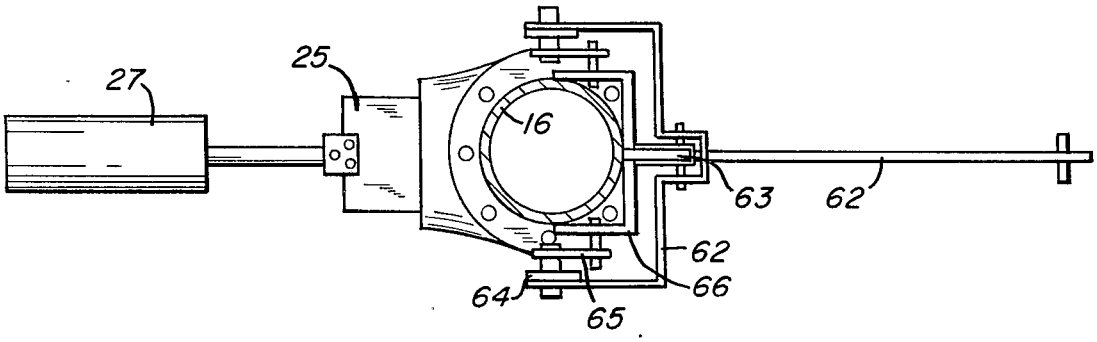
FIG. 4 is a horizontal section on line IV—IV of FIG. 3.
Figure 3:
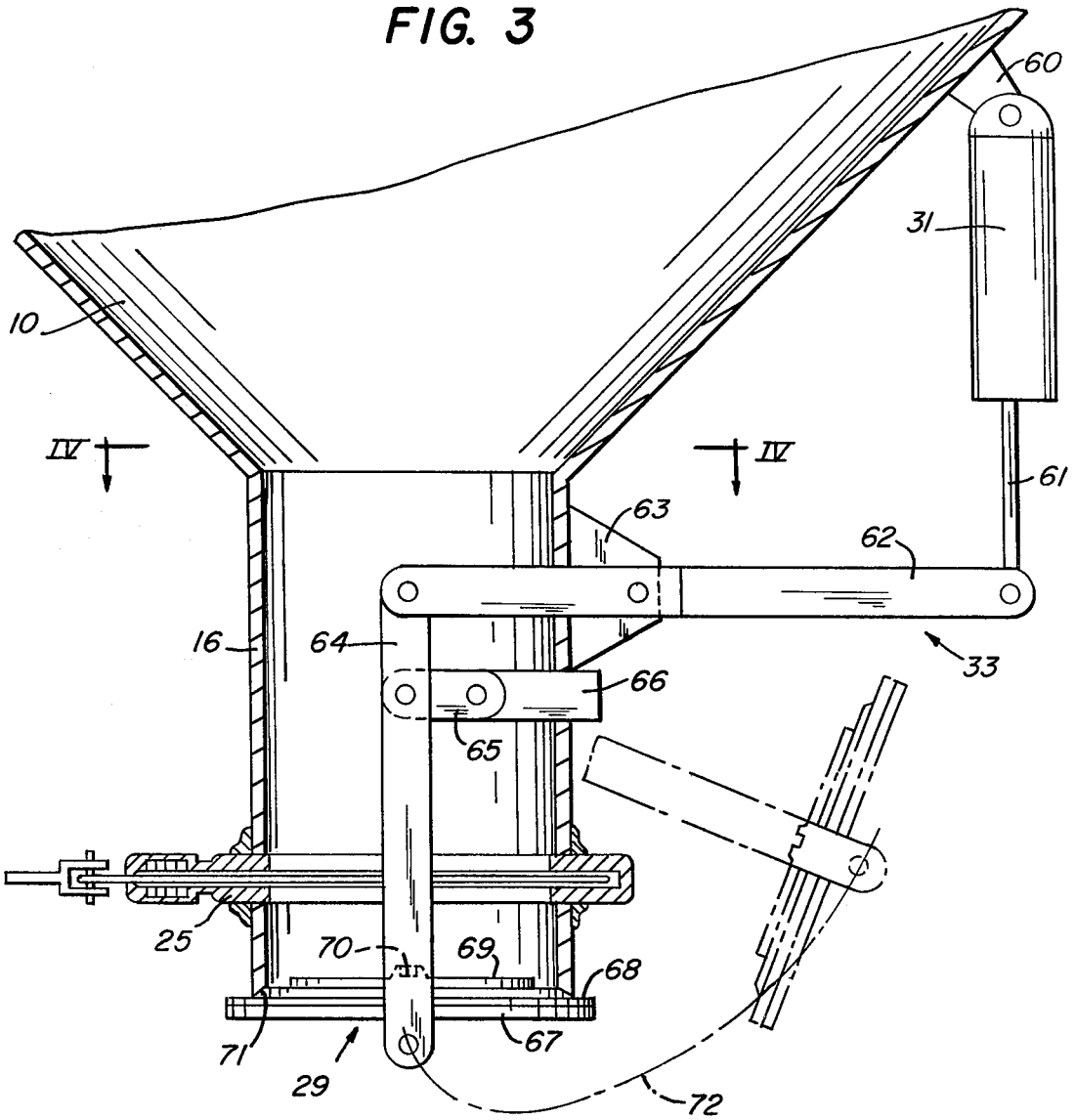
FIG. 3 is a side elevational view, partly in section, of one of the flapper valves and adjacent portions of a chute leading from the surge bin.

FIGS. 3 and 4 show the flapper valve 29 and linkage 33 in more detail. Valve 30 and linkage 34 are similar; hence the showing and description are not repeated. The operating cylinder 31 is pivoted to a bracket 60 fixed to the underside of the surge bin 10 and contains a reciprocable piston and piston rod 61. The lower end of the piston rod is pivoted to a bifurcated lever arm 62 which is pivoted to a bracket 63 fixed to chute 16. Links 64 are pivoted to opposite sides of the lever arm 62 and to short links 65. The latter are pivoted to opposite arms of a U-shaped support 66 fixed to the chute 16. When the flapper valve is closed, the longitudinal axes of the cylinder 31, piston rod 61 and links 64 are substantially vertical, and the longitudinal axes of the lever arm 62 and short links 65 are substantially horizontal.

A metal valve plate 67 is fixed to the lower ends of links 64 and carries a resilient seating pad 68, preferably silicone rubber, held in place by a clamp ring 69 and bolt 70. The pad 68 seats against the lower end of chute 16, which is internally beveled as indicated at 71. The bevel protects the metal seating surface from contact with material discharged from the chute. The angle of bevel is beyond the angle of repose of the material. The gate valve 25 preferably is included to hold back material from the flapper valve, which serves only as a gas seal, but optionally the gate valve can be omitted and the flapper valve used both as a gas seal and to control discharge. Cylinder 31 is operated to retract piston rod 61 to open the flapper valve. The piston rod acts through the linkage 33 to swing the flapper valve through an elliptical arc, as indicated at 72. When the valve is open, it reaches a position where plate 67 and pad 68 are wholly out of the path of material discharging from the chute.

According to the method of the invention, the diverter gate 18 is positioned to discharge material from the downcomer 13 alternately to chutes 14 and 15 and surge bins 10 and 12. Preferably the material discharges continuously to one or the other of these bins. Assuming first the material is discharging to chute 15 and surge bin 12, the gas-seal valve 22 is open, and gate valve 26 and flapper valve 30 are closed. The vent valve 40 is closed and the equalizer valve 44 open. Thus the valves cooperate to prevent escape of reducing gas to the atmosphere. When the level indicator 36 indicates the surge bin 12 is filled, the diverter gate 18 shifts to direct material to the other chute 14 and surge bin 10. Purge fluid is introduced to the purge manifold 52 of valve 22 to clear away any particles of the material from its resilient seat 51, and thereafter the gate 49 of this valve is moved to its closed position. The vent valve 40 is opened to vent gas from bin 12, and the equalizer valve 44 is closed. Thereafter the gate valve 26 and flapper valve 30 are opened to discharge material from bin 12 to conveyor 35. After the bin is vented, the quantity of spent reducing gas accompanying the material is negligible and does not constitute a hazard. As material is diverted to chute 14 and bin 10, valve 21 is opened and valves 25 and 29 closed. The vent valve 39 is closed and equalizer valve 41 opened to equalize the pressure of the bin with the shaft furnace.

From the foregoing description it is seen that my invention affords a simple effective method and apparatus for discharging freshly reduced material from a shaft furnace and controlling release of spent reducing gas so that it does not become a hazard. Although not illustrated, the various steps of operating the diverter gate and opening and closing valves in sequence are readily performed automatically initiated by the level indicators on the surge bins.

I claim:

1. A method of discharging material from a shaft furnace, said method comprising:

discharging material from the furnace to the first of a pair of surge bins with a gas-seal gate valve at the top of the first bin open, said gas-seal gate valve including a gate, an annular resilient seat beneath said gate, an annular purge manifold above said seat and having outlets directed toward said seat, and means for introducing purge fluid to said manifold and a gas-seal flapper valve at the bottom closed;

when the first bin is filled, diverting material from the shaft furnace to the second bin with a gas-seal gate valve at the top of the second bin open and a gas-seal flapper valve at the bottom closed;

purging the valve closure area and the annualar resilient seat of the gas-seal gate valve at the top of the first bin of accumulated material immediately prior to closing the valve and then closing this valve;

opening the gas-seal flapper valve of the first bin; and discharging material from the first bin.

2. A method as defined in claim 1 comprising further steps of venting the first bin before discharging material therefrom and equalizing the pressure of the second bin with the shaft furnace before diverting material thereto.

3. A method of discharging material from a shaft furnace, said method comprising:

discharging material from the furnace to the first of a pair of surge bins with a gas-seal gate valve at the top of the first bin open and a gas-seal flapper valve at the bottom closed;

when the first bin if filled, diverting material from the shaft furnace to the second bin with as gas-seal gate valve at the top of the second bin open and a gas-seal flapper valve at the bottom closed;

purging the gas-seal gate valve at the top of the first bin of accumulated material and closing this valve;

opening the gas-seal flapper valve of the first bin by moving said flapper valve in an elliptical arc out of the path of the material discharge of the bin; and discharging material from the first bin.

4. An apparatus for discharging material from a shaft furnace, said apparatus comprising:

a pair of surge bins;

means for directing material from the shaft furnace selectively to either of said bins;

respective gas-seal valves at the top of said bins;

means for purging said valves of accumulating material prior to shifting them from open to closed position; and respective gas-seal flapper valves and operating linkages therefor at the bottom of said bins for moving said flapper valves through an elliptical arc out of the path of material discharging from the bin.

* * * * *